United States Patent [19]

Opprecht et al.

[11] Patent Number: 4,915,562

[45] Date of Patent: Apr. 10, 1990

[54] RUPTURABLE CAN MEMBER AS WELL AS METHOD AND APPARATUS FOR ITS PRODUCTION

[75] Inventors: Paul Opprecht, Bergdietikon; Werner Urech, Kaiserstuhl, both of Switzerland

[73] Assignee: Elpatronic AG, Zug, Switzerland

[21] Appl. No.: 224,325

[22] Filed: Jul. 26, 1988

Related U.S. Application Data

[60] Continuation of Ser. No. 110,533, Oct. 16, 1987, Pat. No. 4,795,295, which is a continuation of Ser. No. 896,610, Aug. 14, 1986, abandoned, which is a division of Ser. No. 779,885, Sep. 25, 1985, Pat. No. 4,662,534.

[30] Foreign Application Priority Data

Sep. 25, 1984 [CH] Switzerland ..... 4582/84

[51] Int. Cl.[4] ..... B21D 51/28

[52] U.S. Cl. ..... 413/69; 413/14; 413/17; 413/12; 413/55; 413/72

[58] Field of Search ..... 413/4, 14, 15, 54, 55, 413/12, 16, 17, 66, 67, 68, 69, 70–77, 1; 219/64, 79, 80; 198/624; 29/121.6; 220/274, 276

[56] References Cited

U.S. PATENT DOCUMENTS

| | | | |
|---|---|---|---|
| 1,924,472 | 8/1933 | Thomson | 156/204 |
| 2,315,535 | 4/1943 | McCann | 413/72 |
| 2,353,728 | 7/1944 | Hubbell | 219/64 |
| 2,965,263 | 12/1960 | Haidegger | 198/624 |

FOREIGN PATENT DOCUMENTS

| | | | |
|---|---|---|---|
| 148750 | 6/1981 | Fed. Rep. of Germany | 198/624 |

*Primary Examiner*—Judy Hartman
*Assistant Examiner*—Jack Lavinder
*Attorney, Agent, or Firm*—McCormick, Paulding & Huber

[57] ABSTRACT

A rupturable can member (10) of sheet metal has a pair of scorings (16) which define a tearing strip (18) laterally. Welded onto the tearing strip (18) is a tongue (20) which has a thickened portion (24) at its welded-on end (22). This thickened portion is formed by a margin folded back towards the other free end (26) of the tongue (20).

3 Claims, 3 Drawing Sheets

RUPTURABLE CAN MEMBER AS WELL AS METHOD AND APPARATUS FOR ITS PRODUCTION

Figure 1:
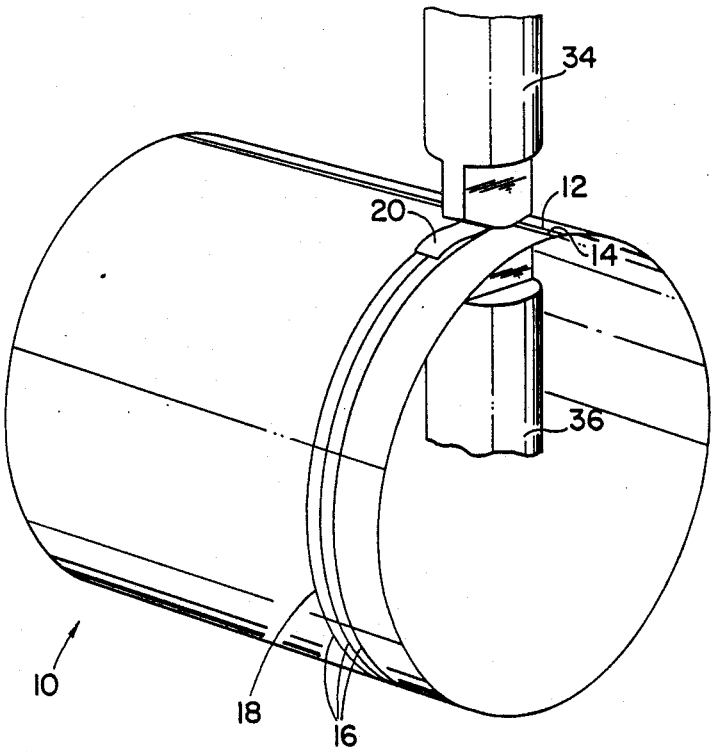
Figure 2A:
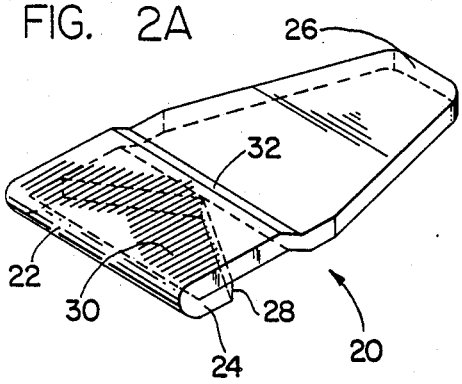
Figure 2B:
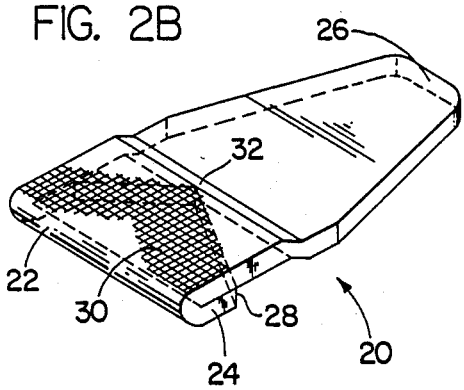
Figure 2C:
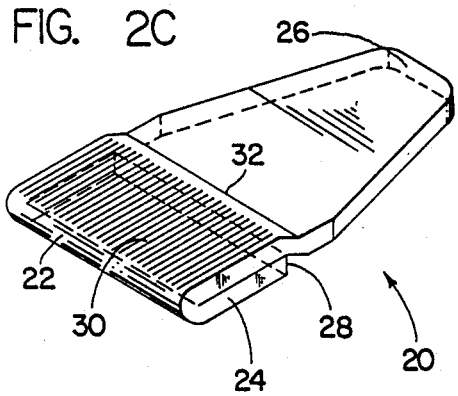
Figure 2D:
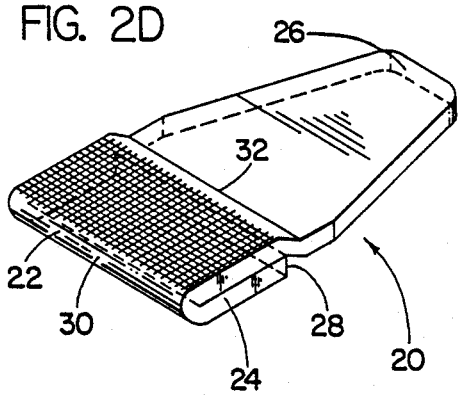
Figure 2E:
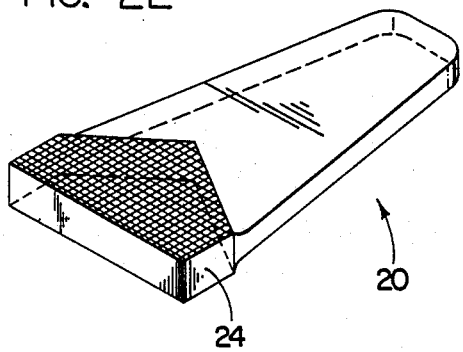
Figure 2F:
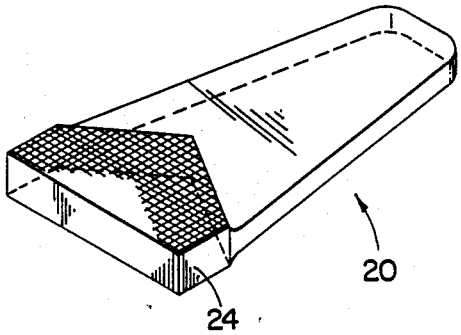

This is a continuation of copending application Ser. No. 110,533 filed on Oct. 16, 1987 now U.S. Pat. No. 4,795,295 which was a continuation of copending application Ser. No. 896,610 filed on Aug. 14, 1986 now abandoned which was a divisional of copending application Ser. No. 779,885 filed on Sept. 25, 1985 now U.S. Pat. No. 4,662,534.

The invention relates to a rupturable can member of sheet metal having a pair of scorings which define a tearing strip laterally and a tongue which, as a separate sheet-metal member, is welded by one of its ends to the tearing strip and extends in the longitudinal direction thereof.

In a known can member (DE-C No. 1 017 042), the tongue is stamped out in one piece together with a sheet-metal blank which is plane in the initial state and in the plane of which the tongue extends beyond one of two longitudinal edges of the sheet-metal blank. A starting scoring, which connects the scorings to one another, is stamped into the sheet-metal blank in the region of the other longitudinal edge together with the two scorings which define the tearing strip laterally. The sheet-metal blank is then rolled up in such a manner that the two longitudinal edges overlap one another and these are then welded to one another to form a longitudinal seam so that a cylindrical can body results. Finally, a complete can is produced from this in that the two ends of the can body are closed by beading to a cover and a bottom respectively. In order to open the can, a key is placed on the tongue and is rolled on the nearest beaded edge.

With these known cans, inexperienced users in particular do not always succeed in removing the tearing strip completely in the desired manner at the first attempt. Not infrequently, the tearing strip tears off already in the region of the longitudinal edges or shortly behind them because converging cracks form which originate from the tongue and meet between the circumferential scorings. The user is the forced to continue the opening of the can with a tool which is not provided for this purpose in which case there is a danger of him injuring himself on sharp sheet-metal edges.

With the intention of making the opening operation more reliable, a can body was proposed in an earlier Application wherein the tongue, as a separate sheet-metal member, is welded by one of its ends to the tearing strip in the region of the outer longitudinal edge. In this case, a starting scoring should preferably be provided between the circumferential scorings, in the region of the inner longitudinal edge of the can body. Nevertheless, it has proved very difficult, in the short cycle times of fractions of a second which have to be adhered to in industrial can production, to weld the tongue so precisely onto the outer longitudinal edge and with such a precisely measured welding current that the opening operation is facilitated in the intended manner but the quality of the longitudinal seam is not reduced.

It is therefore the object of the invention to develop further a can member of the type described at the beginning, particularly a can body with longitudinal edges which are welded to one another or are going to be welded to one another, in such a manner that the opening operation is facilitated without the production or further processing of the can member being made more difficult or the durability of the can being reduced before it is deliberately opened.

According to the invention, the problem is solved in that the tongue comprises, at its welded-on end, a margin which is folded back in the direction of its other, free end.

As a result, tongue and tearing strip are given considerably greater rigidity in the region in which they are welded to one another than can be achieved by the welding on of an unfolded tongue hitherto proposed. The tongue folded back according to the invention and welded at its folded-back margin can be rolled up with a key just as easily as a conventional tongue of the same width and thickness of sheet metal. As soon as the roll formed during the rolling up of the tongue reaches the portion stiffened by the folded over and welded margin, however, a starting crack forms in the tearing strip which crack reaches the two scorings quickly and reliably and then follows these.

The invention is particularly suitable for use on a can member with two longitudinal edges which are welded to one another or are going to be welded to one another in an overlapping manner. In this case, the tongue is preferably welded on outside or remote from the overlapping region of the longitudinal edges. As a result, any influence of the tongue welding on the longitudinal seam welding is avoided. It has been found that the tongue according to the invention can be welded on at any desired point of the tearing strip and no starting scoring is necessary; the positioning of the tongue in relation to the can member to which it is to be welded is therefore possible with simple means and little expenditure of time.

It is particularly advantageous if the margin of the tongue is folded over outwards, away from the sheet metal of the can member. With this arrangement of the folded-over margin, the tongue according to the invention can bear against the sheet metal of the can member as smoothly as an unfolded tongue so that the tongue does not project from the can member or at least does not do so in a disturbing manner and, in addition, the risk of an accidental perforation resulting from a blow on the tongue is kept extremely low. When the tongue is rolled up with a key in the intended manner, however, and the resulting roll reaches the folded back edge, a particularly strong concentration of force results in the tearing strip below this edge and facilitates considerably the required formation of a starting crack.

The intended initial tearing can be still further facilitated as a result of the fact that the folded back margin ends in a marginal edge from which at least one portion extends obliquely to the circumferential scorings. It is an advantage if the folded back margin is arrow-shaped. In particular, the folded back margin may appropriately be rectangular in shape with an equilateral triangle following thereon, the sides of which form the marginal edge.

At its side remote from the folded back margin, the tongue preferably has a zone prepared for the welding on, with a fluted or waffle-like surface structure. This zone preferably has a shape corresponding to the folded back margin, particularly the shape of an arrow pointing towards the free end of the tongue.

Can members according to the invention can be produced by a method wherein a plane sheet-metal blank provided with scorings is rolled up in known manner to form a cylinder with overlapping longitudinal edges, which are subsequently welded to one another. According to the invention, this method is further developed in that the tongue is welded onto the tearing strip and the sheet-metal blank is only then rolled up.

In order to carry out this method, an apparatus may appropriately be used which is provided with a plurality of rollers for rolling up the sheet-metal blanks and which is further developed, according to the invention, in that those rollers which are adapted to act on the side of the sheet-metal blank provided as the outside of the cylinder each comprise an annular groove, the width and depth of which are somewhat greater than the width and thickness of the welded-on tongue together with its folded back margin.

Figure 3:
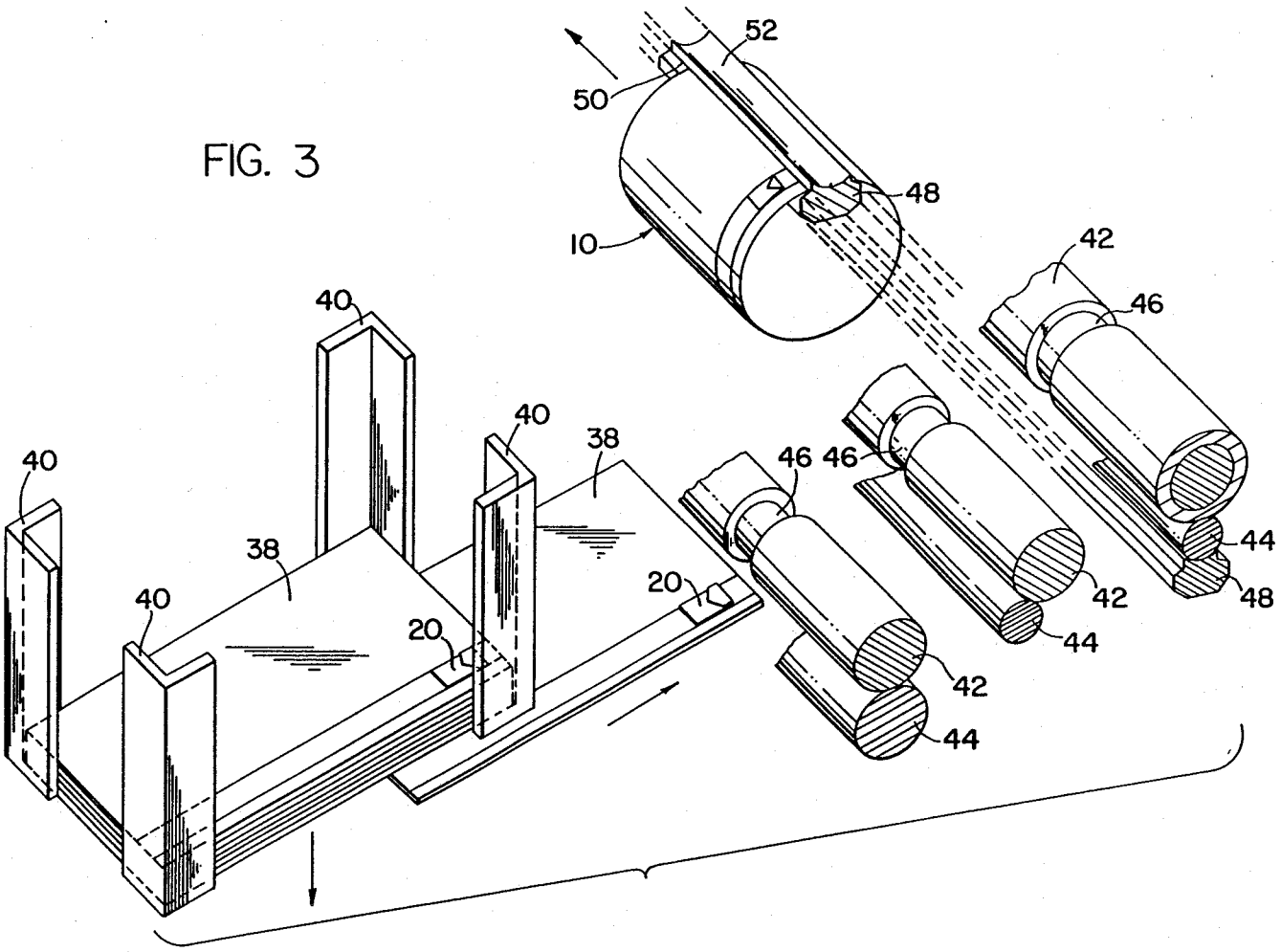

Examples of embodiment of the invention are explained below, with further details, with reference to diagrammatic drawings. They show, each in an oblique view:

FIG. 1 an openable can member with welded-on tongue,

FIGS. *2a–2f* various forms of embodiment of the tongue before it is welded on, and FIG. 3 an apparatus for rolling up can members as shown in FIG. 1.

In FIG. 1, a cylindrical can member 10 is illustrated which consists, for example, of tin plate with a thickness of 0.2 mm. The can member 10 has an outer longitudinal edge 12 and an inner longitudinal edge 14 as well as a pair of outer scorings 16 running in the circumferential direction, which extend at right angles to the longitudinal edges and define a tearing strip 18 between them. The tearing strip 18 may comprise one or more further scorings running parallel to the scorings 16. Welded onto the tearing strip 18 is an elongated tongue 20 which consists, for example, of tin plate with a thickness of 0.4 mm and extends in the longitudinal direction of the tearing strip 18 without reaching one of the longitudinal edges 12 or 14 of the can member 10.

The tongue 20, a plurality of modifications of which are illustrated in detail in FIGS. *2a–2d*, is only welded on in the region of one end 22 which is at a distance from the inner longitudinal edge 14 substantially corresponding to the width of the tearing strip 18. The end 22 which is welded on or is to be welded on comprises a margin 24 which is folded back outwards, away from the can member 10 and which extends in the direction of the other end 26 which is still free after the tongue 20 has been welded on. The free end 26 is narrowed trapezoidally in order to facilitate the slipping on of an ordinary commercial key to open the can member 10.

In all the examples illustrated in FIGS. *2a–2d*, the folded back margin 24 of the tongue 20 has a rectangular region in which in FIGS. *2a* and *2b* only occupies a portion of the length of the folded back margin 24 but in FIGS. *2c* and *2d* occupies the whole length thereof. According to FIGS. *2a* and *2b*, the rectangular region is followed by a triangular region so that the folded back margin 24 is arrow-shaped as a whole. In any case, the folded back margin 24 ends with an outer marginal edge 28, seen from the can member 10, which edge points towards the free end 26 in the form of an arrow according to FIGS. *2a* and *2b* but extends transversely to the scorings 16 according to FIGS. *2c* and *2d*.

In all the modifications illustrated, the tongue 20 has, at its side remote from the folded-back margin 24, a zone 30 which is adapted for welding onto the tearing strip 18 and which has a surface structure which is fluted according to FIGS. *2a* and *2c* but is preferably waffled as shown in FIGS. *2b* and *2d* so that it consists of a multiplicity of small pyramid-shaped projections. Such a surface structure is intended to improve the passage of current and to avoid spattering of tin if the tongue 20 is welded onto the tearing strip 18 by an electrical resistance spot-welding process. The portion of the tongue 20 which is intended to receive a key and which becomes narrower towards the free end 26 is offset in relation to the zone 30 by a small shoulder 32.

According to FIG. 1, the tongue 20 is welded onto the tearing strip 18 by means of two welding electrodes 34 and 36, only after the two longitudinal edges 12 and 14 have already been welded to one another with an overlap in the usual manner.

In FIG. 3, on the other hand, a stack of plain, rectangular sheet-metal blanks 38 is illustrated, each with a welded-on tongue 20. The sheet-metal blanks are received from a mechanism 37, schematically shown, which welds on the tongues in the tear strip as described hereinabove. The stack is guided between vertical guides 40 which release only the bottom sheet-metal blank 38 each time so that this can be conveyed away from the stack and introduced between rollers 42 and 44 which are disposed in pairs and which roll up a cylindrical can member 10 out of each plain sheet-metal blank 38. In each pair of rollers, that roller 42 which acts on the outside of the cylindrical can member 10 being formed, has an annular groove 46 which is so disposed and dimensioned that it allows the tongue 20 to run through unhindered and without jerks.

A rail 48 begins at the last pair of rollers 42, 44 illustrated, round which rail each sheet-metal blank 38 is rolled and along which it is then moved on axially as a cylindrical can member 10. The rail 48 has guide edges 50 and 52 which guide the longitudinal edges 12 and 14 of the can member 10 in such a manner that they approach one another and finally overlap so as to form a lap seam (i.e. compressed or "mash" seam) by electrical resistance seam welding accomplished by mash seam welding schematically shown at 53; for this, reference is made to the DE-C No. 2 559 671 which corresponds to U.S. Pat. No. 4,160,892 for example.

A modification of the tongue 20 which is particularly advantageous from the constructional and production point of view is illustrated in FIG. *2e*. In this tongue, the folding back of the margin is eliminated because here the starting point is a thicker basic sheet and the appropriate reductions are stamped out by rolling or coining leaving only the required thickened portion 24. The honeycomb or waffle pattern is the again provided on this thickened portion in the arrow-shaped as indicated in FIGS. *2a* and *2b*. As a result of these operations, the relatively labour-intensive manipulation of the folding back of the free end can then be eliminated and in addition a considerable hardening of the basic material is achieved by the pressing work, that is to say the tongue is now considerably harder than if it were stamped out of a normal sheet-metal strip.

We claim:

1. An apparatus for producing rupturable cylindrical can members from sheet-metal blanks having a tear strip formed therein, one set of opposed and parallel edges and another set of opposed and parallel edges extending substantially perpendicular to the one set, said apparatus comprising:

a holding means for receiving and stacking said sheet-metal blanks therein, after each of said sheet-metal blanks have a tear strip formed therein and a tongue welded thereon;

a forming roller means sequentially receiving and rolling up the sheet-metal blanks to form cylindrical can members, said forming roller means including plural pairs of opposed rollers with one roller of said roller pairs having an annular groove with a depth and width being respectfully greater than the width and thickness of the welded-on tongue to accommodate the tongue during forming; and a mash seam welding means for receiving said can members and including a rail means positioned with a last pair of rollers having guide edges adapted to receive the respective edges of the one set, said rail means for configuring a received can member such that said edges of the one set approach can another and finally overlap to form a seam, for mash seam welding said edges to one another with said edges having a limited overlap to form a can member.

2. The apparatus according to claim 1 wherein said holding means further comprises means for positioning said stacked blanks with tear strips aligned with one another wherein said forming roller means is configured relative to said holding means with said roller groove being located on the roller in alignment with the tear strip of the blanks stacked in the holding means.

3. An apparatus for producing a rupturable can member from a planar sheet-metal blank having opposed longitudinal edges and transverse edges substantially perpendicular thereto having scorings parallel to said longitudinal edges define a score strip therein, said apparatus comprising:

a means for welding a tongue with a thickened portion and a thin portion to said sheet-metal blank within said strip with said thickened portion disposed towards one of said transverse edges at a remote position therefrom;

a means for sequentially receiving said blank from a holding mechanism for forming a cylindrical can member therefrom, said forming means including plural pairs of opposed rollers with one roller of said roller pairs having an annular groove with a depth and width being respectfully greater than the width and thickness of the welded tongue to accommodate the tongue during forming; and a means receiving said cylindrical can member for mash seam welding said transverse edges to one another with said transverse edges having a limited overlap to form a can member;

said tongue welding means further receiving said sheet-metal blanks prior to said can forming means and positioning said tongue thereon to avoid interfering with the welding of said transverse edges by said mash seam welding means.

* * * * *